US011835195B1

(12) United States Patent
Zhao et al.

(10) Patent No.: US 11,835,195 B1
(45) Date of Patent: Dec. 5, 2023

(54) REAR LAMP WITH ALARM FUNCTION FOR VEHICLE

(71) Applicants: Hyundai Motor Company, Seoul (KR); Kia Corporation, Seoul (KR); Wuhu Anrui Optoelectronics Co., Ltd, Wuhu (CN)

(72) Inventors: Ming Yuan Zhao, Seoul (KR); Jik Soo Shin, Incheon (KR); Young Sub Oh, Suwon-Si (KR); Wendong Liao, Wuhu (CN)

(73) Assignees: Hyundai Motor Company, Seoul (KR); Kia Corporation, Seoul (KR); Wuhu Anrui Optoelectronics Co., Ltd, Wuhu (CN)

( * ) Notice: Subject to any disclaimer, the term of this patent is extended or adjusted under 35 U.S.C. 154(b) by 0 days.

(21) Appl. No.: 18/079,602

(22) Filed: Dec. 12, 2022

(30) Foreign Application Priority Data

Jul. 19, 2022 (CN) ..... 202210849483.7

(51) Int. Cl.

| | |
|---|---|
| ***F21S 43/50*** | (2018.01) |
| ***F21S 43/31*** | (2018.01) |
| ***F21S 43/14*** | (2018.01) |
| ***F21S 43/20*** | (2018.01) |
| *F21W 103/45* | (2018.01) |

(52) U.S. Cl.
CPC ..... *F21S 43/50* (2018.01); *F21S 43/14* (2018.01); *F21S 43/26* (2018.01); *F21S 43/31* (2018.01); *F21W 2103/45* (2018.01)

(58) Field of Classification Search
CPC .. F21S 43/50; F21S 43/14; F21S 43/31; F21S 43/26
See application file for complete search history.

(56) References Cited

U.S. PATENT DOCUMENTS

| | | | | |
|---|---|---|---|---|
| 2005/0231334 | A1* | 10/2005 | Stephens | B60Q 1/34 340/815.45 |
| 2008/0309510 | A1* | 12/2008 | Mandagaran | B60R 1/1207 340/815.45 |
| 2010/0290243 | A1* | 11/2010 | Janssen | F21S 43/239 362/519 |
| 2012/0075875 | A1 | 3/2012 | Son et al. | |
| 2013/0258698 | A1* | 10/2013 | Saito | F21S 43/26 362/520 |
| 2016/0161076 | A1* | 6/2016 | Shibata | B60Q 1/525 362/543 |

(Continued)

FOREIGN PATENT DOCUMENTS

| | | |
|---|---|---|
| CN | 206254899 U | 6/2017 |
| CN | 106864355 B | 5/2019 |

(Continued)

*Primary Examiner* — Christopher E Dunay
(74) *Attorney, Agent, or Firm* — MORGAN, LEWIS & BOCKIUS LLP

(57) ABSTRACT

A rear lamp with an alarm function for a vehicle includes a light source; a reflector reflecting a light emitted from the light source to a mask; a lamp housing accommodating the light source and the reflector therein; and a mask coupled to the lamp housing and transmitting the light reflected by the reflector to an outside of the rear lamp apparatus therethrough, and the mask includes a first optical device capable of forming a pattern on a road, thereby implementing an alarm function.

15 Claims, 14 Drawing Sheets

(56) References Cited

U.S. PATENT DOCUMENTS

| | | | | |
|---|---|---|---|---|
| 2017/0151904 | A1 | 6/2017 | Youn et al. | |
| 2019/0217779 | A1 * | 7/2019 | Tatara ..... | B60Q 1/0011 |

FOREIGN PATENT DOCUMENTS

| | | | |
|---|---|---|---|
| CN | 107089183 | B | 1/2020 |
| JP | 2014-116198 | A | 6/2014 |
| KR | 10-2014-0046205 | A | 4/2014 |
| KR | 10-2017-0062103 | A | 6/2017 |

* cited by examiner

REAR LAMP WITH ALARM FUNCTION FOR VEHICLE

CROSS-REFERENCE TO RELATED APPLICATION

The present application claims priority to and the benefit of Chinese Patent Application No. 202210849483.7 filed in the Chinese National Intellectual Property Administration on Jul. 19, 2022, the entire contents of which is incorporated herein for all purposes by this reference.

BACKGROUND OF THE PRESENT DISCLOSURE

Field of the Present Disclosure

The present disclosure relates to a rear lamp for a vehicle, and more particularly, to a rear lamp with an alarm function for a vehicle.

Description of Related Art

In general, a rear lamp is mounted at a rear portion of a vehicle. When the vehicle is reversing, the rear lamp is turned on to notify other vehicles or pedestrians around the vehicle that the vehicle is reversing. However, at night or in a dark place, because an illumination range of the rear lamp on the road is relatively narrow, it is difficult for other vehicles or pedestrians located next to the vehicle to recognize a reversing situation of the vehicle, which may cause a collision. Accordingly, recently, a rear lamp with an alarm function for a vehicle has been provided. Such a rear lamp forms a specific pattern on the rear of the vehicle so that other vehicles or pedestrians may more easily identify the reversing situation of the vehicle.

In the related art, a technical solution using a multi-reflector generally implements such a rear lamp. As shown in FIG. 1, the rear lamp includes a light source 1, a reflector 2, a lamp housing 3, and a mask 4. The light source 1 and the reflector 2 are mounted on the lamp housing 3, and the reflector 2 reflects a light emitted from the light source 1. The mask 4 is coupled to the lamp housing 3 to transmit the light reflected by the reflector 2 to the outside of the vehicle. To form a specific pattern, the reflector 2 includes a first reflective surface 2-1 and a second reflective surface 2-2. The first reflective surface 2-1 is used for the light emitted from the light source to form the specific pattern on the road, and the second reflective surface 2-2 is used to satisfy a light distribution rule for the rear lamp apparatus.

Currently, a light source generally utilizes LEDs, and each light-emitting diode (LED) projects one pattern onto the road. When a plurality of patterns is to be formed on the road, the technical solution using the multi-reflector may use a plurality of LEDs, and each LED forms corresponding one pattern on the road. When the number of light sources increases, manufacturing cost of the vehicle increases, and a degree of design freedom of the lamp is reduced.

The information included in this Background of the present disclosure is only for enhancement of understanding of the general background of the present disclosure and may not be taken as an acknowledgement or any form of suggestion that this information forms the prior art already known to a person skilled in the art.

BRIEF SUMMARY

Various aspects of the present disclosure are directed to providing a new rear lamp apparatus having advantages of assisting nearby vehicles or pedestrians to recognize a situation in which a vehicle is reversing.

Compared with the technical solution using the multi-reflector, the present disclosure may form a plurality of patterns through one LED, reducing the number of light sources, further reducing manufacturing cost of the vehicle, and improving a degree of design freedom of the vehicle lamp.

Various aspects of the present disclosure are directed to providing a rear lamp apparatus for a vehicle including a light source, a reflector, a lamp housing, and a mask, wherein the reflector is for reflecting a light emitted from the light source, the lamp housing is for accommodating the light source and the reflector, and the mask is coupled to the lamp housing and transmits the light reflected by the reflector to an outside of the vehicle. The mask includes a first optical device configured for forming a pattern on a road, implementing an alarm function.

The mask may further include a second optical device configured for satisfying a light distribution rule of the rear lamp apparatus, and the second optical device may be positioned below the first optical device.

The pattern may include a plurality of pattern regions. The first optical device may include a plurality of pattern optical devices, and each of the pattern optical devices is for forming a corresponding one pattern region among the plurality of pattern regions.

The pattern optical device may have a shape of a sawtooth, so that the sawtooth deflects the light incident on the sawtooth to form the pattern including a predetermined shape, and the sawtooth has a predetermined angle parameter.

The light source includes at least one LED provided in a width direction of the vehicle.

The light source includes a plurality of LEDs provided in the width direction of the vehicle, and the plurality of LEDs are separated by a sidewall of the reflector, so that the light emitted from each of the LEDs is projected to the outside of the rear lamp apparatus through a corresponding portion of the mask.

Respective LEDs of the plurality of LEDs may form the plurality of pattern regions.

The plurality of pattern optical devices includes a first pattern optical device configured for forming a first pattern region among the plurality of pattern regions and a second pattern optical device configured for forming a second pattern region among the plurality of pattern regions, and the first pattern optical device is positioned above the second pattern optical device to allow the first pattern optical device and the second pattern optical device to correspond to the respective LEDs.

In one form, the respective LEDs of the plurality of LEDs form the first pattern region and the second pattern region through the first pattern optical device and the second pattern optical device. A brightness of the pattern is improved by adjusting the predetermined angle parameter of the sawtooth of each of the first pattern optical device and the second pattern optical device corresponding to the respective LEDs according to positions of the respective LEDs, and overlapping the first pattern region and the second pattern region formed by one LED with the first pattern region and the second pattern region formed by another LED on the road.

In another form, the respective LEDs of the plurality of LEDs form the first pattern region and the second pattern region through the first pattern optical device and the second pattern optical device, and a longitudinal direction of the pattern formed by the first pattern region and the second pattern region on the road has a predetermined angle with respect to a center line in the width direction of the vehicle, and the predetermined angle is an acute angle.

Each of the LEDs is for forming one pattern region among the plurality of pattern regions.

The plurality of LEDs includes a first LED and a second LED.

The plurality of pattern optical devices includes a first pattern optical device configured for forming a first pattern region among the plurality of pattern regions and a second pattern optical device configured for forming a second pattern region among the plurality of pattern regions, and the first pattern optical device and the second pattern optical device are provided in parallel in the width direction of the vehicle to allow the first pattern optical device to correspond to the first LED and the second pattern optical device to correspond to the second LED.

The first LED forms the first pattern region through the first pattern optical device, and the second LED forms the second pattern region through the second pattern optical device. The predetermined angle parameter of the sawtooth of each of the first pattern optical device and the second pattern optical device is adjusted according to positions of the first LED and the second LED so that the first pattern region and the second pattern region on the road have a same position with respect to the width direction of the vehicle, and the first pattern region is formed to be closer to the vehicle than the second pattern region.

An angle between a longitudinal direction of the pattern formed by the first pattern region and the second pattern region on the road and the center line in the width direction of the vehicle is 0.

According to an exemplary embodiment of the present disclosure, because the rear lamp apparatus of the vehicle forms a plurality of patterns through one LED, the number of light sources is reduced, furthermore, the manufacturing cost of the vehicle is lowered, and the degree of design freedom of the lamp is improved.

According to an exemplary embodiment of the present disclosure, the rear lamp apparatus of the vehicle forms a specific pattern on the road by installing the pattern optical device on the mask, assisting nearby vehicles or pedestrians to more easily identify the reversing situation of the vehicle.

Furthermore, the effects obtainable or predicted by the exemplary embodiments of the present disclosure are to be included directly or implicitly in the detailed description of the present disclosure. That is, various effects predicted according to various exemplary embodiments of the present disclosure will be included in the detailed description to be described later.

The methods and apparatuses of the present disclosure have other features and advantages which will be apparent from or are set forth in more detail in the accompanying drawings, which are incorporated herein, and the following Detailed Description, which together serve to explain certain principles of the present disclosure.

BRIEF DESCRIPTION OF THE DRAWINGS

Hereinafter, will be more clearly understood through the detailed description shown

Figure 1:
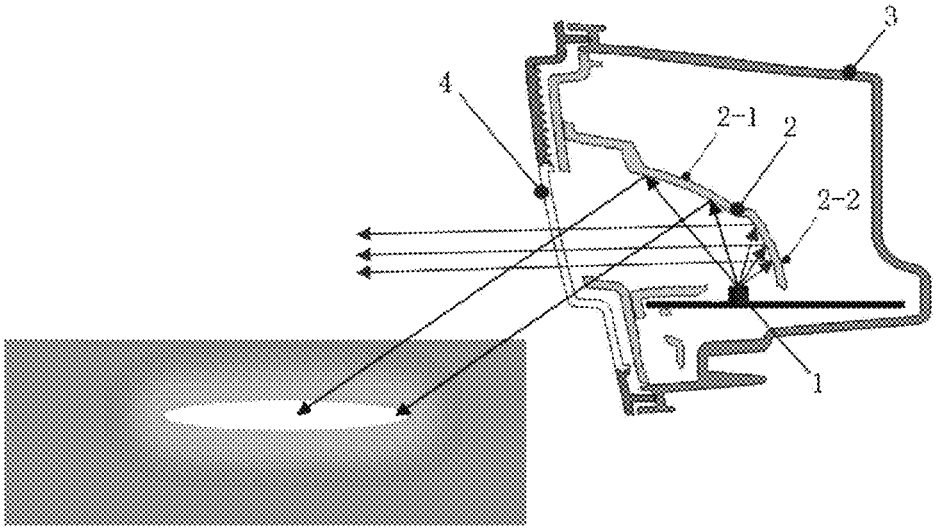
FIG. 1 shows a cross-sectional view of a rear lamp for a vehicle according to the related art.

It may be understood that the appended drawings are not necessarily to scale, presenting a somewhat simplified representation of various features illustrative of the basic principles of the present disclosure. The specific design features of the present disclosure as included herein, including, for example, specific dimensions, orientations, locations, and shapes will be determined in part by the particularly intended application and use environment.

In the figures, reference numbers refer to the same or equivalent parts of the present disclosure throughout the several figures of the drawing.

DETAILED DESCRIPTION

Reference will now be made in detail to various embodiments of the present disclosure(s), examples of which are illustrated in the accompanying drawings and described below. While the present disclosure(s) will be described in conjunction with exemplary embodiments of the present disclosure, it will be understood that the present description is not intended to limit the present disclosure(s) to those exemplary embodiments of the present disclosure. On the other hand, the present disclosure(s) is/are intended to cover not only the exemplary embodiments of the present disclosure, but also various alternatives, modifications, equivalents and other embodiments, which may be included within the spirit and scope of the present disclosure as defined by the appended claims.

It should be understood that the term "vehicle" or "of a vehicle", or other similar terms as used herein, generally refers to automobile such as passenger vehicles, including sports utility vehicles (SUVs), buses, trucks, and passenger vehicles of various commercial vehicles, includes a vessel such as various boats, ships, aircraft, etc., and includes hybrid vehicles, electric vehicles, plug-in hybrid electric vehicles, hydrogen powered vehicles, and other alternative fuel vehicles (e.g., fuels derived from non-petroleum energy sources).

Although it is described in the exemplary embodiment that an exemplary process is performed by use of a plurality of units, it should be understood that the exemplary process may also be performed through one module or a plurality of modules. It should also be understood that the term controller/control unit refers to a hardware device including a memory and a processor. The memory is configured to store a module, and the processor is specifically configured to execute the module to complete one or a plurality of processes additionally described below.

The terminology used in the text is only for describing embodiments, and is not for limiting the present disclosure. As used herein, the singular forms "a," "an," and "the" also include the plural, unless the context clearly explains otherwise. Also, as used herein, the term "comprising" is intended to indicate the presence of the feature, number, step, action, element, and/or component but does not exclude the presence or addition of one or more other features, numbers, steps, acts, elements, components, and/or groups. As used herein, the term "and/or" includes any and all combinations of one or more of the associated listed items.

Hereinafter, a rear lamp of a vehicle according to various exemplary embodiments of the present disclosure will be described with reference to the drawings.

Figure 2:
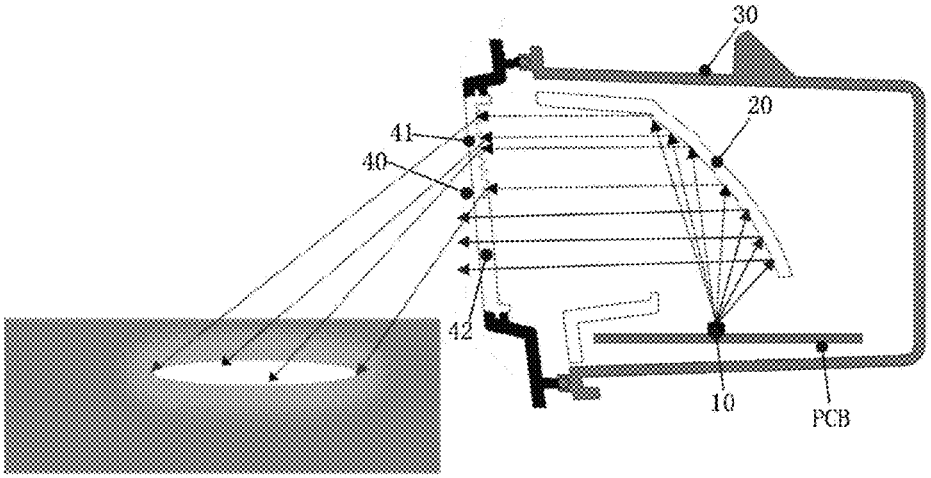
FIG. 2 is a cross-sectional view of a rear lamp for a vehicle according to various exemplary embodiments of the present disclosure.

FIG. 2 is a cross-sectional view of a rear lamp for a vehicle according to various exemplary embodiments of the present disclosure. Hereinafter, a rear lamp for the vehicle according to various exemplary embodiments of the present disclosure will be described with reference to FIG. 2.

The rear lamp for the vehicle according to the exemplary embodiment of the present disclosure includes a light source 10, a reflector 20, a lamp housing 30, and a mask 40. The reflector 20 reflects a light emitted from the light source 10 to the mask 40, and the light source 10 and the reflector 20 are mounted on the lamp housing 30. The mask 40 is coupled to the lamp housing 30 to cover the light source 10, and the light reflected by the reflector 20 is provided to penetrate to an outside of the rear lamp through the mask 40. The mask 40 includes a first optical device 41 and a second optical device 42. The first optical device 41 forms a pattern on the road to implement an alarm function, and the second optical device 42 satisfies a light distribution rule for the rear lamp.

The light source 10 may be an LED, and the LED is disposed on a printed circuit board (PCB). According to a size and an expected function of the rear lamp, the number, color and power of the LEDs used may be selected. In the exemplary embodiment of the present disclosure, for convenience of description, two LEDs are explained as an exemplary embodiment of the present disclosure, but a person of an ordinary skill in the art may understand that two or more LEDs may be used according to the size and demanded brightness of the rear lamp. All the LEDs are provided in parallel in a width direction of the vehicle, and the LEDs are separated by a side wall of the reflector 20, so that the light emitted from each LED is projected to the outside of the rear lamp only through a portion of the corresponding mask 40 in front of each LED. An opening is provided in front of the reflector 20, and a size of the opening is designed to prevent the light emitted from the light source 10 from being directly incident on the mask 40 without passing through the reflector 20.

The reflector 20 may be provided on an upper side of the light source 10, and may also be in a form of a concave reflector. At the instant time, the light source 10 may be disposed at a focal point of a reflecting mirror, so that the light emitted from the light source may be emitted uniformly and in parallel. However, the form of the reflector 20 is not limited thereto, and the reflector 20 may be various reflector devices including a reflection function. Each LED may correspond to one reflector 20, and the reflector 20 corresponding to each LED may be the same.

The mask 40 is provided in front of the reflector 20, and receives the light of the light source reflected by the reflector 20. The mask 40 is made of a transparent material of high transmittance so that the light reflected from the reflector 20 is transmitted to the outside of the rear lamp with a relatively low loss through the mask 40. Because the mask 40 has an optical pattern in the width direction (height direction) of the vehicle, the light incident on the mask 40 is deflected and then refracted to the ground.

Additionally, the first optical device 41 and the second optical device 42 are integrally formed, and are molded directly on an internal surface of the mask 40 facing the light source 10. The first optical device 41 is positioned above the second optical device 42. In FIG. 2, FIG. 3, FIG. 4 and FIG. 5, the light emitted by the first optical device 41 is indicated by a dotted line, and the light emitted by the second optical device 42 is indicated by a solid line.

Additionally, the first optical device 41 of the mask 40 may include a plurality of pattern optical devices. In the exemplary embodiment of the present disclosure, for convenience of description, two pattern optical devices are explained as an exemplary embodiment of the present disclosure, but a person of an ordinary skill in the art may understand that two or more pattern optical devices may be used according to the size and design of the rear lamp. The second optical device 42 of the mask 40 may have a structure generally used for a mask of a rear lamp known to a person of an ordinary skill in the art, and a detailed description thereof will be omitted herein.

The pattern formed by the rear lamp according to various exemplary embodiments of the present disclosure may include a plurality of pattern regions, and each of the pattern optical devices is for forming one pattern region among the plurality of pattern regions.

Figure 3:
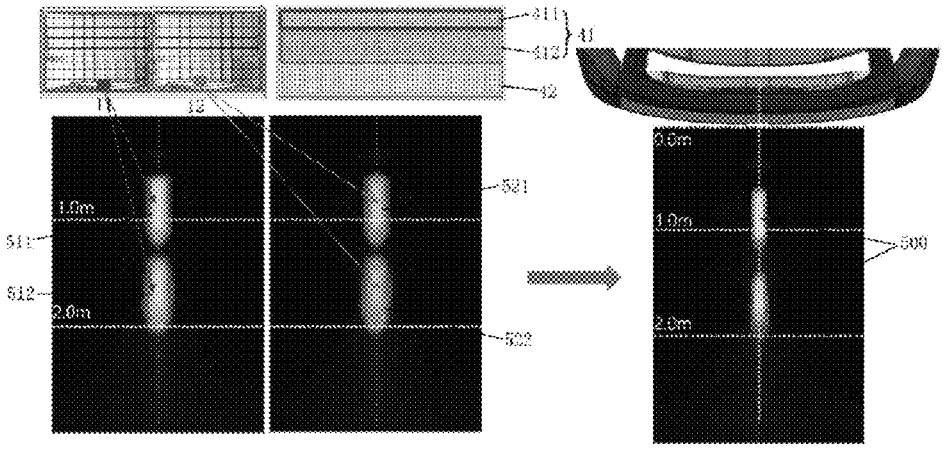
FIG. 3 shows a pattern formed by a rear lamp for a vehicle according to various exemplary embodiments of the present disclosure.
Figure 4:
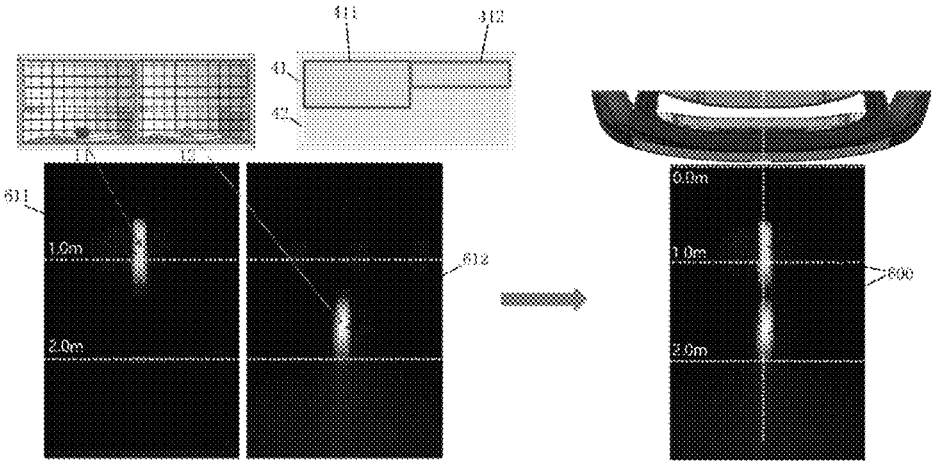
FIG. 4 shows a pattern formed by a rear lamp for a vehicle according to various exemplary embodiments of the present disclosure.
Figure 5:
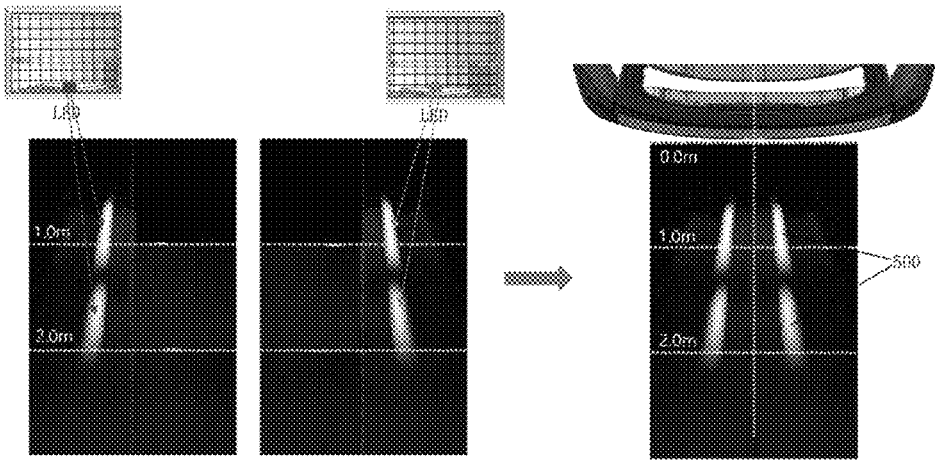
FIG. 5 shows a pattern formed by a rear lamp for a vehicle according to various exemplary embodiments of the present disclosure.

Here, the pattern or pattern region refers to a pattern in which the light is projected onto the ground through the first optical device 41 of the mask 40, for example, a pattern 500 illustrated in FIG. 3, FIG. 4, and FIG. 5. In the exemplary embodiment of the present disclosure, two pattern regions are explained as an exemplary embodiment of the present disclosure, for convenience of description, but a person of an ordinary skill in the art may understand that a pattern including two or more pattern regions may be formed according to a design.

The shape of each pattern region is determined by a parameter of the pattern optical device forming the pattern region. In the exemplary embodiment of the present disclosure, each pattern region is referred to as a long strip, but a shape of the pattern region is not limited thereto. According to the design of the pattern optical device, a pattern region such as a square, a rhombus, a circle, or an oval may be formed.

The pattern optical device according to various exemplary embodiments of the present disclosure has an external surface facing the outside of the lamp and an internal surface facing inside of the lamp. The external surface of the pattern optical device is a flat plane, and forms a constant inclination angle with the height direction of the vehicle, and the angle is determined according to an exterior of exterior of the vehicle.

Figure 6A:
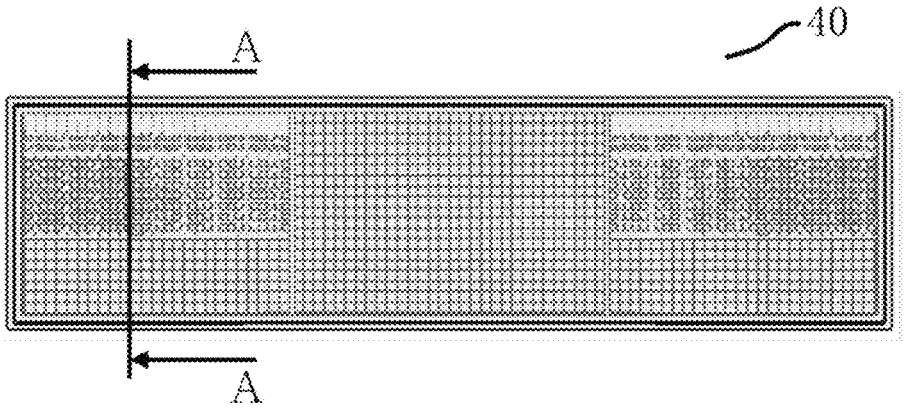
FIG. 6A, FIG. 6B, FIG. 6C, and FIG. 6D are cross-sectional views of pattern optical devices according to various exemplary embodiments of the present disclosure.
Figure 6B:
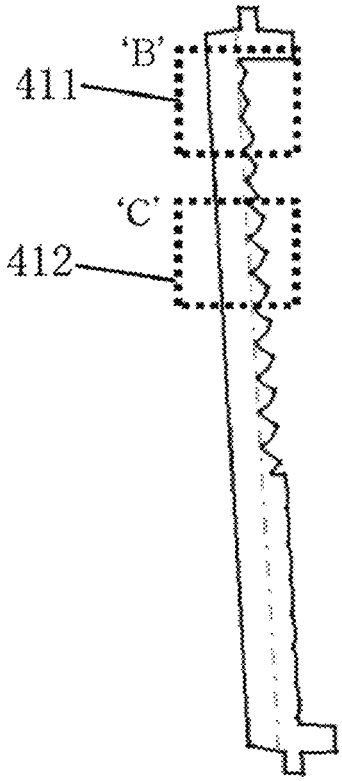
Figure 6C:
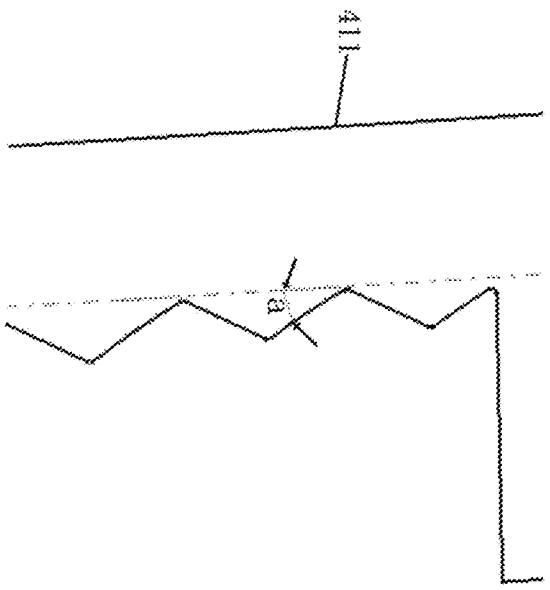
Figure 7A:
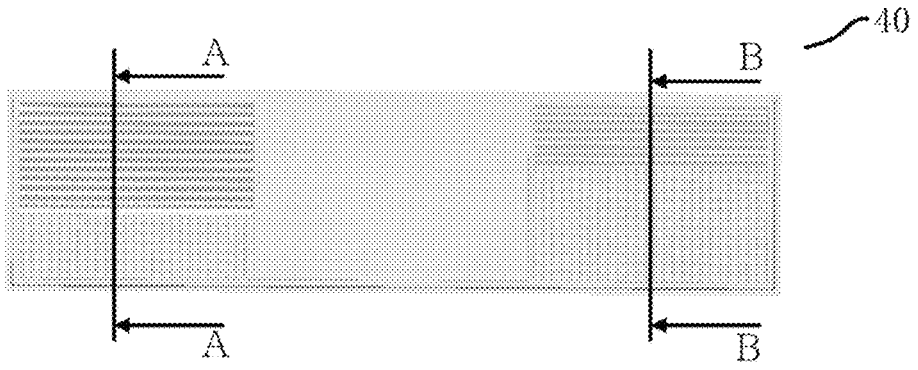
FIG. 7A, FIG. 7B, FIG. 7C, FIG. 7D, and FIG. 7E are cross-sectional views of pattern optical devices according to various exemplary embodiments of the present disclosure.
Figure 7B:
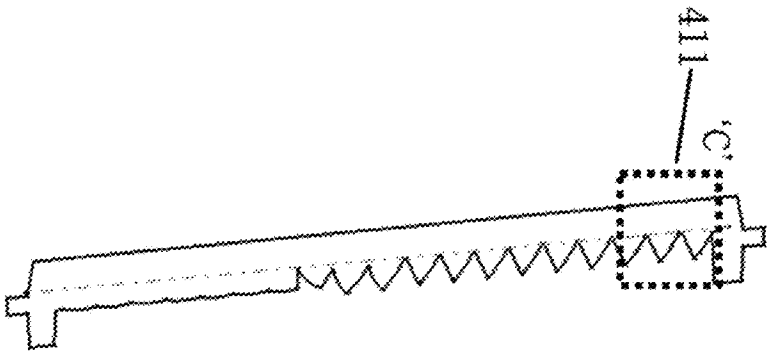
Figure 7C:
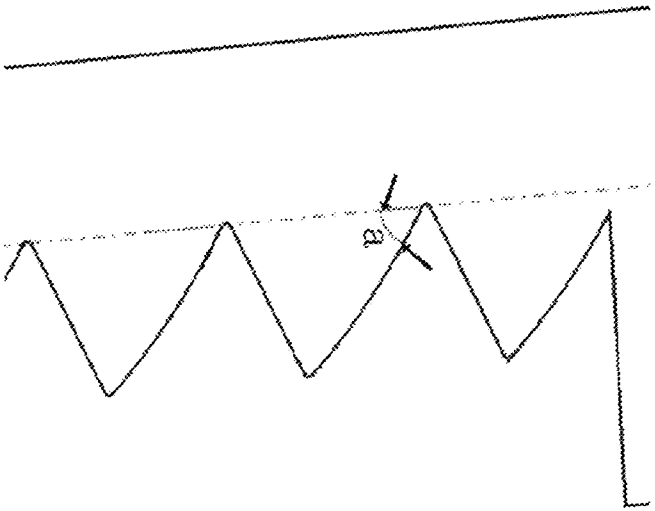

As shown in FIGS. 6C and 7C, in a vertical cross-section of the rear lamp, the internal surface of the pattern optical device has a saw-toothed shape, and each sawtooth has an upper sawtooth surface and a lower sawtooth surface. The surface of the sawtooth may be a generally flat surface or a surface including a constant curvature. According to the principle of refraction, the upper sawtooth surface deflects downward the light which is substantially horizontally incident thereon. Because the lower sawtooth surface has no function to change a light path and is used only to be connected to a sawtooth of each row, the shape of the lower sawtooth surface is not limited.

As shown in FIG. 2, the light incident on the upper sawtooth surface of the sawtooth of the pattern optical device is refracted and deflected downward. The sawteeth may have a predetermined angle parameter.

Figure 7D:
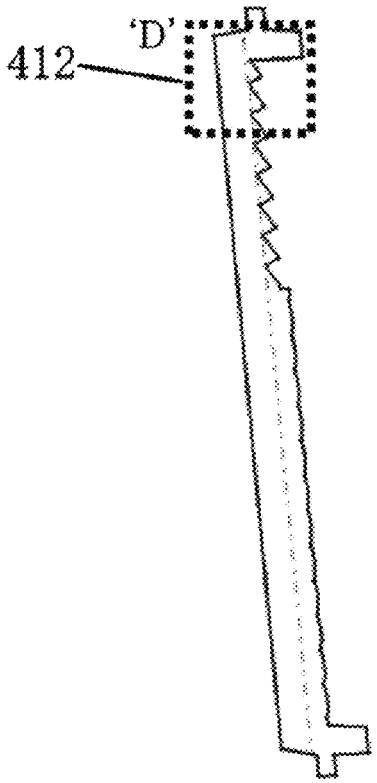
Figure 7E:
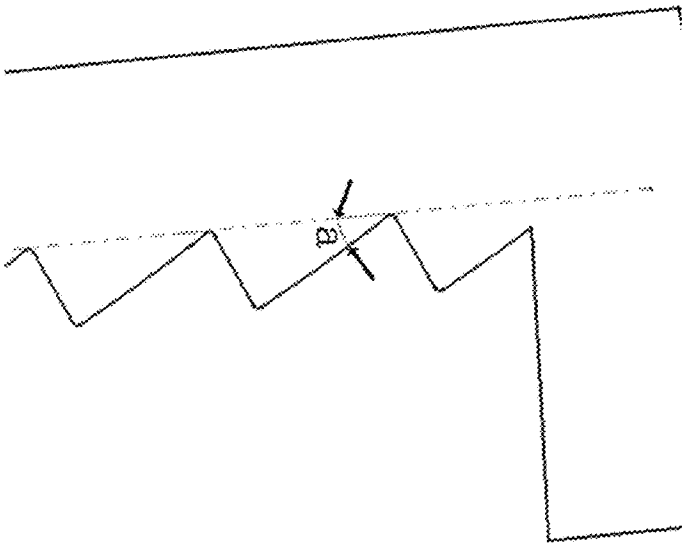

Here, the angle parameter of the sawtooth means an angle α between the upper sawtooth surface of the sawtooth and the external surface of the pattern optical device, and the angle α is indicated in both FIGS. 6C and 7C. The larger the angle α is, the closer to the vehicle the light ray projected through the sawtooth becomes, and the smaller the angle is, the farther from the vehicle the light ray projected through the sawtooth becomes. As shown in FIGS. 7C and 7E, the angle parameter of the sawtooth of the first pattern optical device (shown in FIG. 7C) is greater than the angle parameter of the sawtooth of the second pattern optical device (shown in FIG. 7E). Correspondingly, a pattern region 611 formed by the first pattern optical device is closer to the vehicle than a pattern region 612 formed by the second pattern optical device (shown in FIG. 4).

At the same time, the angle parameter of the sawtooth is designed as follows. In the height direction of the vehicle, the higher the position of the sawtooth is, the farther away from the vehicle the position of the light deflected by the sawtooth and projected on the road is. In the present way, in the height direction of the vehicle, the lights deflected by different sawteeth do not intersect. The angle parameter of the sawtooth is determined by a mounting height of the rear lamp, the projection position of the pattern on the road, and the shape and the size of the pattern region.

FIG. 3, FIG. 4, and FIG. 5 illustrate patterns formed by a rear lamp for a vehicle according to various embodiments of the present disclosure.

FIG. 3 shows the pattern formed by the rear lamp for the vehicle according to various exemplary embodiments of the present disclosure. Hereinafter, the pattern formed by the rear lamp for the vehicle according to the exemplary embodiment of the present disclosure will be described with reference to FIG. 3.

As shown in FIG. 3, the light source 10 includes a first LED 11 and a second LED 12. The first optical device 41 includes a first pattern optical device 411 and a second pattern optical device 412. The first pattern optical device 411 is positioned above the second pattern optical device 412, and the first pattern optical device 411 corresponds to the first LED 11 and the second LED 12, and the second pattern optical device 412 corresponds to the first LED 11 and the second LED 12. The first pattern optical device 411 is for forming a first pattern region, and the second pattern optical device 412 is for forming a second pattern region. Through such an arrangement, a light emitted by the first LED 11 is emitted simultaneously through the first pattern optical device 411 and the second pattern optical device 412, the light emitted by the first pattern optical device 411 forms a first pattern region 512, and the light emitted by the second pattern optical device 412 forms a second pattern region 511. Similarly, a light emitted from the second LED 12 is emitted simultaneously through the first pattern optical device 411 and the second pattern optical device 412, the light emitted through the first pattern optical device 411 forms a first pattern region 522, and the light emitted through the second pattern optical device 412 forms a second pattern region 521.

That is, each LED is for forming all pattern regions.

The light emitted from the first LED 11 is incident on the reflector 20, and thereafter, the reflector 20 makes uniformly and in parallel the light incident on the mask 40. The light incident on the first optical device 41 of the mask 40 is refracted by the upper sawtooth surface of the sawtooth on the first optical device 41 and deflected downward, and the light incident on the second optical device 42 of the mask 40 is transmitted directly to satisfy the light distribution rule of the rear lamp. As a result, the light incident on the first pattern optical device 411 on the upper portion of the first optical device 41 is emitted to form the first pattern region 512 far away from the vehicle to the rear of the vehicle on the road, and the light incident on the second pattern optical device 412 on the lower portion of the first optical device 41 is emitted to form the second pattern region 511 close to the vehicle to the rear of the vehicle on the road.

At the same time, the light emitted from the second LED 12 is incident on the reflector 20, and thereafter, the reflector 20 makes the light uniformly and in parallel incident on the mask 40. The light incident on the first optical device 41 of the mask 40 is refracted by the upper sawtooth surface of the sawtooth on the first optical device 41 and deflected downward, and the light incident on the second optical device 42 of the mask 40 is transmitted directly to satisfy the light distribution rule of the rear lamp. As a result, the light incident on the first pattern optical device 411 on the upper portion of the first optical device 41 is emitted to form the first pattern region 522 far away from the vehicle to the rear of the vehicle on the road, and the light incident on the second pattern optical device 412 on the lower portion of the first optical device 41 is emitted to form the second pattern region 521 close to the vehicle to the rear of the vehicle on the road.

According to the positions of the first LED 11 and the second LED 12, the angle parameter of the sawtooth of the first pattern optical device 411 and the second pattern optical device 412 corresponding to the first LED 11 is different from the angle parameter of the sawtooth of the first pattern optical device 411 and the second pattern optical device 412 corresponding to the second LED 12 so that the first pattern region 512 formed by the first LED 11 and the first pattern region 522 formed by the second LED 12 may overlap at a specific position on the road, and the second pattern region 511 formed by the first LED 11 and the second pattern region 512 formed by the second LED 12 may also overlap at a specific location on the road. The brightness of a final pattern formed through such overlapping may be improved. According to the width and brightness demand of the rear lamp, more LEDs may be provided. This method is advantageous for an exemplary embodiment of implementing a rear lamp by use of a plurality of LEDs of low brightness.

In an exemplary embodiment of the present disclosure, a final pattern 500 is formed by overlapping two strip-shaped pattern regions (i.e., the first pattern region 512 and the second pattern region 511) formed by the first LED 11 and two strip-shaped pattern regions (i.e., the first pattern region 522 and the second pattern region 521) formed by the second LED 12 each other. With regard to the size of the strip-shaped pattern region, for example, the length of the pattern is 600 mm, the width is 150 mm, and the distance between two adjacent patterns is 200 mm. The distance between the strip-shaped pattern region close to the vehicle and the rear side of the vehicle is 1 m, and the distance between the strip-shaped pattern region far away from the vehicle and the rear side of the vehicle is, for example, 2 m. However, the distance between the pattern region and the rear side of the vehicle is not limited thereto. If necessary, the distance between the first pattern region and the second pattern region and the rear side of the vehicle may be changed by changing the angle parameters of the sawteeth of the first pattern optical device 411 and the second pattern optical device 412.

An angle between the longitudinal direction of the strip-shaped pattern region and the center line in the width direction of the vehicle shown in FIG. 3 is 0 degree, and the formed final pattern is positioned at the center portion of the vehicle, but this is only exemplary. The position of the final pattern in the width direction of the vehicle may be changed as needed. The rear lamp of the vehicle according to the exemplary embodiment may be mounted on one or both sides of the left and right sides of the rear side of the vehicle, or may be mounted on the center portion of the rear side of the vehicle.

FIG. 4 shows the pattern formed by the rear lamp for the vehicle according to various exemplary embodiments of the present disclosure. Hereinafter, the pattern formed by the rear lamp for the vehicle according to the exemplary embodiment of the present disclosure will be described with reference to FIG. 4.

As shown in FIG. 4, the light source 10 includes the first LED 11 and the second LED 12, and the first optical device 41 includes the first pattern optical device 411 and the second pattern optical device 412. The difference from the various exemplary embodiments are that the first pattern optical device 411 and the second pattern optical device 412 are provided in parallel in the width direction of the vehicle, and the first pattern optical device 411 is positioned on the left side of the second pattern optical device 412, so that the first pattern optical device 411 corresponds only to the first LED 11, and the second pattern optical device 412 corresponds to only the second LED 12. The first pattern optical device 411 is for forming the first pattern region, and the second pattern optical device 412 is for forming the second pattern region. Through such an installation, the light emitted from the first LED 11 is emitted only through the first pattern optical device 411 to form the first pattern region 611. Similarly, the light emitted from the second LED 12 is emitted only through the second pattern optical device 412 to form the second pattern region 612.

That is, each LED is for forming one pattern region among all pattern regions.

The light emitted from the first LED 11 is incident on the reflector 20, and then, the reflector 20 makes uniformly and in parallel the light incident on the mask 40. The light incident on the first optical device 41 of the mask 40 is refracted by the upper sawtooth surface of the sawtooth on the first optical device 41 and deflected downward, and the light incident on the second optical device 42 of the mask 40 is transmitted directly to satisfy the light distribution rule of the rear lamp. As a result, the light incident on the first pattern optical device 411 of the left side of the first optical device 41 is emitted to form the first pattern region 611 close to the vehicle to the rear of the vehicle on the road.

At the same time, the light emitted from the second LED 12 is incident on the reflector 20, and thereafter, the reflector 20 makes the light uniformly and in parallel incident on the mask 40. The light incident on the first optical device 41 of the mask 40 is refracted by the upper sawtooth surface of the sawtooth on the first optical device 41 and deflected downward, and the light incident on the second optical device 42 of the mask 40 is transmitted directly to satisfy the light distribution rule of the rear lamp. As a result, the light incident on the second pattern optical device 412 of the right side of the first optical device 41 is emitted to form the second pattern region 612 far away from the vehicle to the rear of the vehicle on the road.

According to the positions of the first LED 11 and the second LED 12, the angle parameters of the sawteeth of the first pattern optical device 411 and the second pattern optical device 412 are different. For example, the first pattern region 611 formed by the first LED 11 and the second pattern region 612 formed by the second LED 12 are formed on the road as follows. The first pattern region 611 and the second pattern region 612 have the same position in the width direction of the vehicle, and the first pattern region 611 is closer to the vehicle than the second pattern region 612. In an exemplary embodiment of the present disclosure, one pattern region may be formed through each LED, and the number of pattern regions corresponding to the number of LEDs may be implemented. This is advantageous for an exemplary embodiment in which the brightness of a single LED meets the brightness requirement of the rear lamp while the width of the rear lamp is required relatively strictly.

In an exemplary embodiment of the present disclosure, the final pattern 600 is formed by combining one strip-shaped pattern region (i.e., the first pattern region 611) formed by the first LED 11 and one strip-shaped pattern region (i.e., the second pattern region 612) formed by the second LED 12.

The final pattern 600 is the same as the pattern formed by the rear lamp shown in FIG. 3. The angle between the longitudinal direction of the strip-shaped pattern region and the center line in the width direction of the vehicle shown in FIG. 4 is 0 degree, and the formed final pattern is positioned at the center portion of the vehicle, but this is only exemplary. If necessary, the position of the final pattern in the width direction of the vehicle may be changed. The rear lamp of the vehicle according to the exemplary embodiment may be mounted on one or both sides of the left and right sides of the rear side of the vehicle, or may be mounted on the center portion of the rear side of the vehicle.

FIG. 5 shows the pattern formed by the rear lamp for the vehicle according to various exemplary embodiments of the present disclosure. Hereinafter, the pattern formed by the rear lamp for the vehicle according to the exemplary embodiment of the present disclosure will be described with reference to FIG. 5.

Description of the same parts between the various exemplary embodiments shown in FIG. 5 and the various exemplary embodiments shown in FIG. 3 will be omitted. As shown in FIG. 5, the difference between the various exemplary embodiments and the various exemplary embodiments are that the longitudinal direction of a strip-shaped pattern region of the various exemplary embodiments has a predetermined angle with respect to the center line in the width direction of the vehicle, and the angle is an acute angle. Because each strip-shaped pattern region has the same predetermined angle, and connection lines of the centers of a plurality of strip-shaped pattern regions are on the same straight line, the farther from the rear side of the vehicle the strip-shaped pattern region is, the closer to the outside the strip-shaped pattern region in the width direction of the vehicle is. The rear lamp for the vehicle according to the exemplary embodiment may be mounted in the center portion of the rear side of the vehicle. In the instant case, in consideration of the symmetry of the pattern, two symmetrical divergent patterns may be formed on the road by mounting two identical rear lamps symmetrically on the center portion of the rear side of the vehicle. Accordingly, aesthetics may be improved.

FIG. 6A, FIG. 6B, FIG. 6C, and FIGS. 6D and 7A to 7E are cross-sectional views of pattern optical devices according to exemplary embodiments of the present disclosure. Hereinafter, the rear lamp for the vehicle according to exemplary embodiments of the present disclosure will be described in more detail by taking the exemplary embodiments shown in FIG. 6A, FIG. 6B, FIG. 6C, and FIGS. 6D and 7A to 7E as an example.

The exemplary embodiment shown in FIG. 6A, FIG. 6B, FIG. 6C, and FIG. 6D utilizes a structure of the rear lamp for the vehicle according to the various exemplary embodiments of the present disclosure. That is, in the exemplary embodiment shown in FIG. 6A, FIG. 6B, FIG. 6C, and FIG. 6D, each LED is for forming at least two pattern regions. In the above embodiment, the rear lamp for the vehicle is mounted at the center portion of the rear side of the vehicle, and the mounting height of the rear lamp is 490 mm from the ground. The light source includes two LEDs, and the distance between the two LEDs is 118 mm. The first optical device includes two pattern optical devices provided in the height direction of the vehicle, and the two pattern optical devices are provided to correspond to the two LEDs.

Figure 6D:
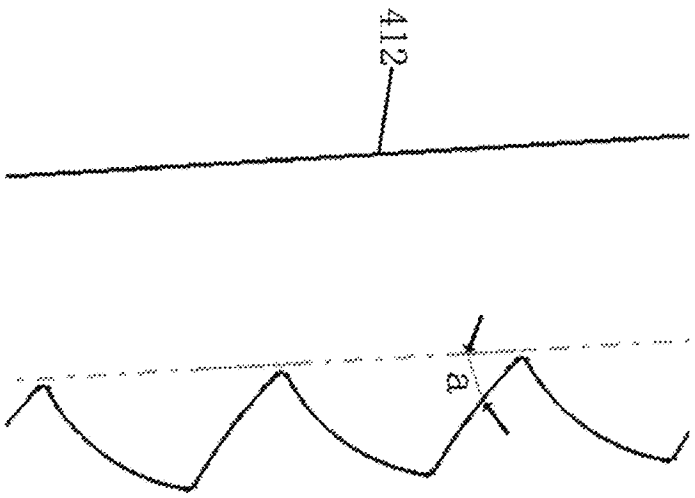

FIG. 6A shows the mask 40. FIG. 6B is a cross-sectional view of the mask 40 cut along the line A-A of FIG. 6A, a part 'B' corresponds to the first pattern optical device 411, and apart 'C' corresponds to the second pattern optical device 412. FIG. 6C is an enlarged schematic view of the part 'B' of FIG. 6B. FIG. 6D is an enlarged schematic view of the part 'C' of FIG. 6B. The angle parameter a of the sawtooth of the first pattern optical device 411 is 27.65°, and the angle parameter a of the sawtooth of the second pattern optical device 412 is 46°. The final pattern formed on the road through the pattern optical device is the pattern 500 shown in FIG. 3. The pattern regions 512 and 522 formed by the first pattern optical device 411 are 2 m away from the rear side of the vehicle, and the pattern regions 511 and 521 formed by the second pattern optical device 412 are 1 m away from the rear side of the vehicle.

The exemplary embodiment shown in FIG. 7A, FIG. 7B, FIG. 7C, FIG. 7D, and FIG. 7E utilizes a structure of the rear lamp for the vehicle according to the various exemplary embodiments of the present disclosure. That is, in the exemplary embodiment shown in FIGS. 7A to 7E, each LED is for forming one pattern region. In the above embodiment, the rear lamp of the vehicle is mounted at the center portion of the rear side of the vehicle, and the mounting height of the rear lamp is 490 mm from the ground. The light source includes two LEDs, and the distance between the two LEDs is 118 mm. The first optical device includes two pattern optical devices provided in parallel in the width direction of the vehicle, and the two pattern optical devices are respectively provided to correspond to the two LEDs.

FIG. 7A shows the mask 40. FIG. 7B is a cross-sectional view of the mask 40 cut along the line A-A of FIG. 7A, and the part 'C' corresponds to the first pattern optical device 411. FIG. 7C is an enlarged schematic view of the part 'C' of FIG. 7B. FIG. 7D is a cross-sectional view of the mask 40 cut along the line B-B of FIG. 7A, and a part 'D' corresponds to the second pattern optical device 412. FIG. 7E is an enlarged schematic view of the part 'D' of FIG. 7D. The angle parameter a of the sawtooth of the first pattern optical device 411 is 59.49°, and the angle parameter a of the sawtooth of the second pattern optical device 412 is 33.15°. The final pattern formed on the road through the pattern optical device is the pattern 600 shown in FIG. 4, and the pattern region 611 formed by the first pattern optical device 411 is 1 m away from the rear side of the vehicle, and the pattern region 612 formed by the second pattern optical device 412 is 2 m away from the rear side of the vehicle.

The rear lamp of the vehicle according to the exemplary embodiment of the present disclosure forms a plurality of patterns through one LED, reducing the number of light sources, furthermore, lowering manufacturing cost of the vehicle, and improving a degree of design freedom of the lamp.

The rear lamp of the vehicle according to various exemplary embodiments of the present disclosure forms the specific pattern on the road by installing the pattern optical device on the mask, assisting nearby vehicles or pedestrians to more easily identify a reversing situation of the vehicle.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present disclosure have been presented for purposes of illustration and description. They are not intended to be exhaustive or to limit the present disclosure to the precise forms disclosed, and obviously many modifications and variations are possible in light of the above teachings. The exemplary embodiments were chosen and described in order to explain certain principles of the invention and their practical application, to enable others skilled in the art to make and utilize various exemplary embodiments of the present disclosure, as well as various alternatives and modifications thereof. It is intended that the scope of the present disclosure be defined by the Claims appended hereto and their equivalents.

What is claimed is:

1. A rear lamp apparatus for a vehicle, the rear lamp apparatus comprising:

a light source;

a single reflector having a focal point centered on the light source, wherein the single reflector is configured to reflect light emitted from the light source as substantially parallel light rays directed in one direction;

a lamp housing accommodating the light source and the reflector therein; and a unitary mask coupled to the lamp housing and transmitting the light reflected by the reflector to an outside of the rear lamp apparatus therethrough, wherein the unitary mask includes a first optical device and a second optical device, wherein the first optical device is configured to receive a first portion of the substantially parallel light rays and the second optical device is configured to receive a second portion of the substantially parallel light rays, and wherein the first optical device is configured to direct the first portion of the substantially parallel light rays as a pattern on a road surface, and wherein the second optical device is configured to direct the second portion of the substantially parallel light rays such that a rear light distribution rule of the rear lamp apparatus is satisfied.

2. The rear lamp apparatus of claim 1, wherein at least one of the first and second light areas includes a plurality of pattern regions, and wherein each of the first and second optical devices includes, at least one pattern optical device, and respective pattern optical device is configured to form one pattern region.

3. The rear lamp apparatus of claim 2, wherein the at least one pattern optical device has a shape of a sawtooth, and the sawtooth deflects the light incident on the sawtooth to form the at least one of the first and second light areas including a predetermined shape, and the sawtooth has a predetermined angle parameter.

4. The rear lamp apparatus of claim 2, wherein the light source includes at least one light-emitting diode (LED) provided in a width direction of the vehicle.

5. The rear lamp apparatus of claim 4, wherein the light source includes a plurality of LEDs provided in the width direction of the vehicle, and the plurality of LEDs are separated by a sidewall of the reflector, so that the light emitted from each of the LEDs is projected to the outside of the rear lamp apparatus through a corresponding portion of the mask.

6. The rear lamp apparatus of claim 5, wherein respective LED of the plurality of LEDs forms a plurality of pattern regions included in the at least one of the first and second light areas.

7. The rear lamp apparatus of claim 6, wherein the at least one pattern optical device includes a first pattern optical device configured for forming a first pattern region and a second pattern optical device configured for forming a second pattern region, and wherein the first pattern optical device is positioned above the second pattern optical device such that the light emitted from each of the LEDs passes through both of the first and second pattern optical devices.

8. The rear lamp apparatus of claim 7, wherein the respective LED forms the first pattern region and the second pattern region through the first pattern optical device and the second pattern optical device, and wherein the first pattern optical device and the second pattern optical device are configured for overlapping the first pattern region and the second pattern region formed by a first LED with the first pattern region and the second pattern region formed by a second LED, respectively.

9. The rear lamp apparatus of claim 8, the first pattern optical device and the second pattern optical device are configured for forming the first pattern region farther from the vehicle than the second pattern region.

10. The rear lamp apparatus of claim 7, wherein the respective LED forms the first pattern region and the second pattern region through the first pattern optical device and the second pattern optical device, wherein the first pattern optical device is configured to form the first pattern region and the second pattern by a first LED and the second pattern optical device is configured to form the first pattern region and the second pattern region by a second LED, and wherein the first pattern region and the second pattern region formed by the first LED are linearly aligned and the first pattern region and the second pattern region formed by the second LED are linearly aligned.

11. The rear lamp apparatus of claim 10, the first pattern region and the second pattern region formed by the first LED and the first pattern region and the second pattern region formed by the second LED are spaced with each other in a width direction of the vehicle.

12. The rear lamp apparatus of claim 10, wherein the first pattern region and the second pattern region formed by the first LED are arranged on a first line and the first pattern region and the second pattern region formed by the second LED are arranged on a second line, and wherein at least one of the first line and the second line has a predetermined angle with respect to a center line in a width direction of the vehicle, and the predetermined angle is an acute angle.

13. The rear lamp apparatus of claim 6, wherein the at least one pattern optical device includes a first pattern optical device configured for forming a first pattern region among the plurality of pattern regions and a second pattern optical device configured for forming a second pattern region among the plurality of pattern regions, and wherein the first pattern optical device and the second pattern optical device are provided in parallel in a width direction of the vehicle such that the light emitted from a first LED passes through the first pattern optical device and the light emitted from a second LED passes through the second pattern optical device.

14. The rear lamp apparatus of claim 13, wherein the first pattern optical device and the second pattern optical device are configured for forming the first pattern region farther from the vehicle than the second pattern region.

15. The rear lamp apparatus of claim 14, wherein the first LED forms the first pattern region through the first pattern optical device, and the second LED forms the second pattern region through the second pattern optical device, and wherein the first pattern region and the second pattern region are formed on the road and have a same position with respect to the width direction of the vehicle.

* * * * *